US005345150A

United States Patent [19]

Biegel

[11] Patent Number: 5,345,150

[45] Date of Patent: Sep. 6, 1994

[54] REGULATING LIGHT INTENSITY BY MEANS OF MAGNETIC CORE WITH MULTIPLE WINDINGS

[75] Inventor: George E. Biegel, Framingham, Mass.

[73] Assignee: Stocker & Yale, Inc., Beverly, Mass.

[21] Appl. No.: 857,781

[22] Filed: Mar. 26, 1992

[51] Int. Cl.[5] ..... H05B 41/391

[52] U.S. Cl. ..... 315/280; 315/255; 315/291; 315/294; 315/324; 315/DIG. 4; 315/284

[58] Field of Search ..... 315/283, 284, 291, 294, 315/297, 307, 311, DIG. 4, DIG. 5, 312, 324, 254, 255, 256, 276–282

[56] References Cited

U.S. PATENT DOCUMENTS

| | | | |
|---|---|---|---|
| 2,298,904 | 10/1942 | Scott et al. | 176/124 |
| 2,458,277 | 1/1949 | Lark et al. | 315/284 |
| 2,471,222 | 5/1949 | Lorant | 336/40 |
| 2,829,314 | 4/1958 | Vradenburgh | 315/284 |
| 2,878,425 | 3/1959 | Kudoh | 315/284 |
| 3,209,202 | 11/1961 | Dunigan | 315/99 |
| 3,377,508 | 4/1968 | Gomonet | 315/250 |
| 3,514,668 | 5/1970 | Johnson et al. | 315/205 |

(List continued on next page.)

FOREIGN PATENT DOCUMENTS

| | | | |
|---|---|---|---|
| WO91/13530 | 9/1991 | PCT Int'l Appl. | H05B 37/02 |
| 0670680 | 4/1952 | United Kingdom | 315/DIG. 4 |

OTHER PUBLICATIONS

Storm, "*Magnetic Amplifiers*", Chapter 2, 4–7, and 21–24; pp. 29–46, 62–112, and 341–410; 1959 John Wiley & Sons.

Lithonia Lighting, Litronic TM and Equinox TM brochure; pp. 301 and 312; date unknown.

Advance Transformer Co., "Mark VII Controllable Integrated Circuit Ballasts" 1991.

ETTA Industries, Inc. "Specifications for the Etta Fiberoptic Sunsensor"; 1991.

Forest M. Mims III, Radio Shack, Engineer's Mini-Notebook; "Optoelectronics Circuits"; Cat. No. 276–5012; date unknown.

Ghecrghiu et al., Tratat de Masini Electrice; "Transformatoare"; vol. AL-II-LEA; pp. 455–457; 1970.

Veinott et al., Electric Motors, "Fractional and Subfractional Horsepower"; Fourth Edition; pp. 176–179; date unknown.

*Primary Examiner*—David Mis

*Attorney, Agent, or Firm*—Fish & Richardson

[57] ABSTRACT

A device for regulating the intensity of light emitted by a lamp includes a core of magnetic material, a first electrical circuit having a primary inductor wrapped around at least a portion of the core of magnetic material, and a second electrical circuit having a secondary inductor wrapped around at least a portion of the core of magnetic material. The first electrical circuit is designed for electrical connection to the lamp, and the primary inductor is arranged in the first electrical circuit in a manner such that a variation in the inductance of the primary inductor will cause a corresponding variation in the intensity of light emitted by the lamp. The second electrical circuit includes a control device (e.g., a variable impedance) for varying, at will, electrical current passing through the secondary inductor to cause a variation in the degree of saturation of the core of magnetic material around which the primary and secondary inductors are wrapped so that the inductance of the primary inductor in turn is varied, causing a change in the intensity of light emitted by the lamp. The control device is electrically isolated from voltage potentials present in the first electrical circuit.

30 Claims, 5 Drawing Sheets

U.S. PATENT DOCUMENTS

| | | | |
|---|---|---|---|
| 3,573,544 | 4/1971 | Zonis | 315/206 |
| 3,599,037 | 8/1971 | Grace | 315/284 X |
| 3,611,021 | 10/1971 | Wallace | 315/307 |
| 3,659,147 | 4/1972 | Widmayer | 315/107 |
| 3,873,910 | 3/1975 | Willis, Jr. | 323/6 |
| 3,898,516 | 8/1975 | Nakasone | 315/194 |
| 3,980,921 | 9/1976 | Izawa | 315/206 |
| 4,180,764 | 12/1979 | Morup | 315/283 |
| 4,210,846 | 6/1980 | Capewell et al. | 315/121 |
| 4,251,752 | 2/1981 | Stolz | 315/206 |
| 4,341,979 | 7/1982 | Gross et al. | 315/57 |
| 4,349,768 | 9/1982 | Miller | 315/105 |
| 4,358,716 | 11/1982 | Cordes et al. | 315/306 |
| 4,367,434 | 1/1983 | Miller | 315/51 |
| 4,370,600 | 1/1983 | Zansky | 315/244 |
| 4,392,086 | 7/1983 | Ide et al. | 315/174 |
| 4,443,740 | 4/1984 | Goralnik | 315/284 |
| 4,443,778 | 4/1984 | Mewissen | 336/90 |
| 4,460,849 | 7/1984 | Virtanen | 315/209 R |
| 4,475,064 | 10/1984 | Burgess | 315/227 R |
| 4,477,748 | 10/1984 | Grubbs | 315/306 |
| 4,492,899 | 1/1985 | Martin | 315/308 |
| 4,518,895 | 5/1985 | Lehman | 315/117 |
| 4,523,129 | 6/1985 | Pitel | 315/291 |
| 4,523,131 | 6/1985 | Zansky | 315/307 |
| 4,540,917 | 9/1985 | Luchaco et al. | 315/291 |
| 4,551,699 | 11/1985 | Jong et al. | 336/135 |
| 4,559,479 | 12/1985 | Munson | 315/239 |
| 4,604,552 | 8/1986 | Alley et al. | 315/176 |
| 4,612,478 | 9/1986 | Payne | 315/176 |
| 4,645,979 | 2/1987 | Chow | 315/169 |
| 4,663,569 | 5/1987 | Alley et al. | 315/175 |
| 4,663,570 | 5/1987 | Luchaco et al. | 315/219 |
| 4,700,113 | 10/1987 | Stupp et al. | 315/224 |
| 4,712,045 | 12/1987 | Van Meurs | 315/224 |
| 4,734,650 | 3/1988 | Alley et al. | 324/414 |
| 4,766,353 | 8/1988 | Burgess | 315/324 |
| 4,853,598 | 8/1989 | Kusko et al. | 315/101 |
| 4,876,498 | 10/1989 | Luchaco et al. | 323/300 |
| 4,894,587 | 1/1990 | Jungreis et al. | 315/200 R |
| 4,926,097 | 5/1990 | Taek | 315/307 |
| 4,950,959 | 8/1990 | Beckrot et al. | 315/219 |
| 4,998,046 | 3/1991 | Lester | 315/209 R |
| 5,001,386 | 3/1991 | Sullivan et al. | 315/219 |
| 5,015,922 | 5/1991 | M/ hling | 315/282 |
| 5,023,518 | 6/1991 | Mans et al. | 315/219 |
| 5,041,763 | 8/1991 | Sullivan et al. | 315/176 |
| 5,059,870 | 10/1991 | Choon | 315/289 |

REGULATING LIGHT INTENSITY BY MEANS OF MAGNETIC CORE WITH MULTIPLE WINDINGS

CROSS REFERENCE TO RELATED APPLICATION

The present application is related to now U.S. Pat. No. 5,239,239, filed by George E. Biegel and John H. Rieman on the same day as the present application and commonly assigned with the present application.

BACKGROUND OF THE INVENTION

The present invention relates in general to regulating the intensity of light emitted by a lamp and more particularly concerns light dimming circuits having variable inductors.

Light dimming circuits can provide substantial energy savings by permitting a user to reduce light intensity to a desired level or by permitting automatic regulation of light intensity based on, e.g., the time of day or input from a motion detector that detects the presence of a person in a room.

Light dimming circuits for fluorescent lamps and the like are known in which light intensity is varied by adjusting the inductance of a variable inductor. Examples of such circuits are disclosed in U.S. Pat. No. 5,140,228 filed Feb. 23, 1990, the entire disclosure of which is incorporated herein by reference. In particular, the above-mentioned U.S. application discloses a variable inductor connected in parallel with a fluorescent lamp powered by a high-frequency alternating current. Other light dimming circuits for fluorescent lamps powered at lower frequencies include a variable inductor connected in series with the lamp.

The inductance of the variable inductor disclosed in the above-mentioned U.S. application is varied by adjusting the geometry of the ferrite core around which the inductor is wrapped.

SUMMARY OF THE INVENTION

According to the invention, there is a device for regulating the intensity of light emitted by a lamp, the device including a core of magnetic material, a first electrical circuit having a primary inductor wrapped around at least a portion of the core of magnetic material, and a second electrical circuit having a secondary inductor wrapped around at least a portion of the core of magnetic material. The first electrical circuit is designed for electrical connection to the lamp, and the primary inductor is arranged in the first electrical circuit in a manner such that a variation in the inductance of the primary inductor will cause a corresponding variation in the intensity of light emitted by the lamp. The second electrical circuit includes a control device (e.g., a variable impedance) for varying electrical current passing through the secondary inductor to cause a variation in the degree of saturation of the core of magnetic material around which the primary and secondary inductors are wrapped so that the inductance of the primary inductor in turn is varied, causing a change in the intensity of light emitted by the lamp.

The second electrical circuit may be powered by a low D.C. or A.C. voltage, and because the control device in the second electrical circuit is isolated from the much higher voltages present in the first electrical circuit it may be manipulated by a user safely and may be easily located at any convenient location remote from the first electrical circuit. Thus, for example, the control device can be wired through walls without special grounding or similar equipment.

The lamp is preferably a discharge lamp such as a fluorescent lamp. In one embodiment the lamp operates at frequencies less than 1 kilohertz and the primary inductor is connected in series with the lamp, and in another embodiment the lamp operates at frequencies above 1 kilohertz and the primary inductor is connected in parallel with the lamp. The secondary inductor and the control device may be electrically connected to a source of electrical power that provides the current passing through the secondary inductor, or the current passing through the secondary inductor may simply be the current induced in the secondary inductor by the current passing through the primary inductor. The control device may be, e.g., a variable resistance, a variable capacitance, or a variable inductance, and may be constructed to be manually adjusted to vary the electrical current passing through the secondary inductor. A filter may be connected between the secondary inductor and the control device to filter out high-frequency components of the current passing through the secondary inductor. The control device may vary the electrical current passing through the secondary inductor either in discrete steps or continuously.

One advantage of the variable inductor according to the invention is that it may be easily controlled, in one embodiment of the invention, by a receiver arranged to detect control signals transmitted from a remote location (e.g., electromagnetic radiation signals, sonic signals, or even electrical signals transmitted on an electric power line). In this embodiment the receiver is connected to the control device in a manner such that the receiver causes the control device to vary the electrical current passing through the secondary inductor in accordance with the control signals transmitted from the remote location. The receiver may be powered by the same source of electrical power that provides the current passing through the secondary inductor and the control device.

A further advantage of the variable inductor according to the invention is that a single control device can be connected to a plurality of secondary inductors to vary simultaneously the electrical current passing through each of the plurality of secondary inductors, so that a plurality of lamps can be dimmed simultaneously. This embodiment of the invention includes a corresponding plurality of primary inductors and a corresponding plurality of cores of magnetic material, each of the secondary inductors and each of the primary inductors being wrapped around at least a portion of a corresponding core. Each of the circuit elements (i.e., primary and secondary inductors) may be identical to the circuit elements that would be used with a single lamp, thereby providing a simple and inexpensive circuit for simultaneously controlling a plurality of lamps.

Because the light regulation circuitry according to the invention is not incorporated into a power supply or an inverter circuit, a unit including a primary inductor, secondary inductor, and magnetic core may be retro-fitted to an existing lamp circuit including an existing power supply that produces electrical current of a frequency suitable for the lamp. The primary inductor is electrically connected to at least one output terminal of the power supply: in one embodiment the primary inductor being connected between the output terminal of the power supply and the lamp, and in another embodiment the primary inductor being connected in parallel with the lamp. Moreover, the existing lamp circuit may include an existing inductive ballast, such as an electronic ballast incorporated into the power supply, or a choke ballast with which the primary inductor is connected in series.

A further advantage of the invention is that it permits the primary and secondary inductors to be configured to surround a portion of the lamp. The primary and secondary inductors are preferably wound on a cylindrical bobbin that fits over an end portion of the lamp. There are preferably a plurality of cores of magnetic material, configured in a substantially rectangular shape enclosing a region through which the primary and secondary inductors pass, and the cylindrical bobbin has indentations to accommodate the cores of magnetic material. In a preferred embodiment, at least a pair of slip-on terminals are configured to slip over pins of the lamp to provide a pair of electrical connections between the primary inductor and the pins, one of the slip-on terminals also providing an electrical connection between the secondary inductor and one of the pins. Thus, the invention permits the primary and secondary inductors and the core of magnetic material to be easily attached to a lamp simply by sliding the assembly over one of the ends of the lamp and attaching the slip-on terminals to the lamp pins.

Numerous other features, objects, and advantages of the invention will become apparent from the following detailed description when read in connection with the accompanying drawings.

DETAILED DESCRIPTION

Figure 1:
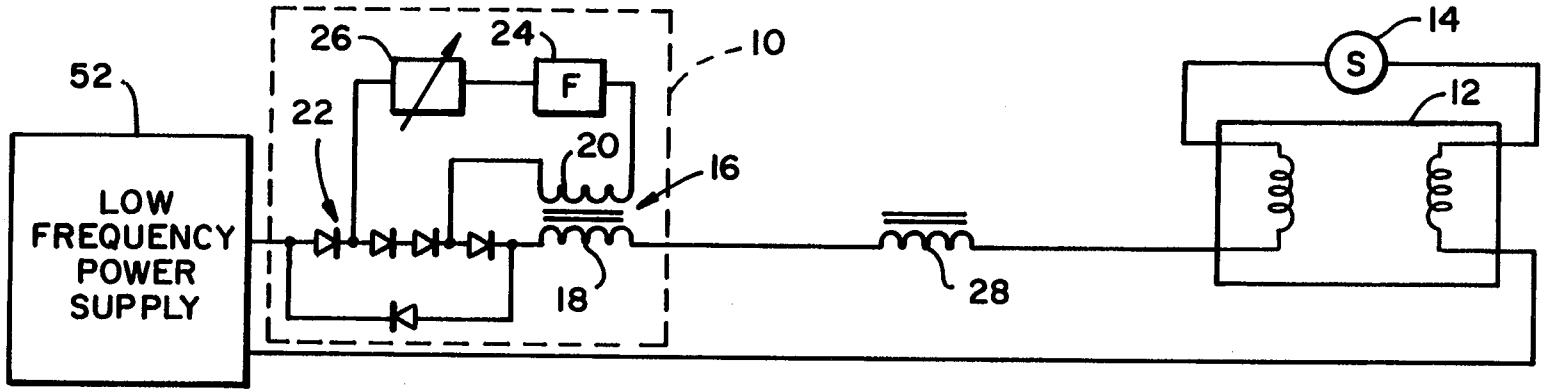
FIG. 1 shows a circuit for regulating light intensity in accordance with the invention, for use with a fluorescent lamp powered by a low-frequency alternating current.

With reference now to the drawings and more particularly FIG. 1 thereof, there is shown a device 10 for regulating the intensity of light emitted by a fluorescent lamp 12 powered by a low-frequency power supply 52 (less than 1 kilohertz) and connected to starter 14. Light regulation device 10 includes a transformer structure 16 having a core of magnetic material around which a primary inductor 18 and a secondary inductor 20 are wrapped, and it will be seen that it is possible to vary the intensity of light emitted by fluorescent lamp 12 by varying the current passing through secondary inductor 20. In particular, when the inductance of primary inductor 18 is increased, the voltage drop across fluorescent lamp 12 correspondingly decreases and consequently the intensity of light emitted by fluorescent lamp 12 decreases, and vice versa. When the current passing through secondary inductor 20 increases, the degree of saturation of the core of magnetic material increases, thereby decreasing the inductance of primary inductor 18, and vice versa. Thus, by varying the current through Secondary inductor 20, it is possible to vary the intensity of light emitted by fluorescent lamp 12.

Diodes 22 are provided in one of the input A.C. power lines to permit a small D.C. voltage to be derived from the power line for use in a circuit that includes secondary inductor 20, the voltage depending upon the particular diode material and the number of diodes placed between the inner two circuit nodes. All of the elements in the circuit that includes secondary inductor 20 are isolated from the relatively high voltages present in the circuit that includes primary inductor 18. Filter 24 filters out the A.C. components of the signal passing through secondary inductor 20, the A.C. components being present because the D.C. voltage derived from diodes 22 is a half-wave rectified signal and because the A.C. current passing through primary inductor 18 induces an A.C. current in secondary inductor 20. By filtering out the A.C. components of the signal passing through secondary inductor 20, filter 24 prevents these A.C. components from inducing an undesired A.C. current in primary inductor 18 and prevents the A.C. components from damaging any of the circuit elements in the circuit that includes secondary inductor 20.

The current passing through secondary inductor 20 may alternatively be provided by a small battery such as a watch battery, or any other suitable source. For example, there may be ways to derive a voltage from a transformer on main power, a remote source such as a computer, the power supply, or the receiver shown in FIG. 4 below. It is also possible to use the voltage across the filament on one or the other side of the fluorescent lamp, either in the low-frequency embodiment of FIG. 1 or the high-frequency embodiment of FIG. 3 below. This current may be an alternating current, in which case no filter is needed if the alternating current has the same frequency as the alternating current passing through primary inductor 18. If an A.C. current is used through secondary inductor 20, a greater current is needed to vary the degree of saturation of the magnetic core than would be required if a D.C. current were used. The D.C. or A.C. voltage through secondary inductor 20 is preferably relatively low, as is the current.

Control device 26, which varies the current passing through secondary inductor 20, may be a variable impedance (either a variable resistance, a variable capacitance, or a variable inductance). A variable resistor is acceptable if the current passing through secondary inductor 20 is a D.C. current, but if the current passing through secondary inductor 20 is an A.C. current, a high-wattage resistor would be needed to accommodate the higher current, and thus a variable capacitance or a variable inductance is preferable, especially in view of the fact that a variable capacitor or inductor has very little heat loss. Examples of variable inductances that could be used are disclosed in the above-mentioned U.S. Pat. No. 5,140,228, filed Feb. 23, 1990. Control device 26 may vary light intensity either in discrete steps or continuously, and may be, for example, a knob have a setting for turning fluorescent lamp 12 on and off, the on/off setting typically being adjacent the setting for full intensity.

Because light regulation device 10 is not incorporated into a power supply or inverter circuit, light device 10 may be retro-fitted to an existing fluorescent lamp circuit having a pre-existing power supply 52, which may incorporate a pre-existing electronic ballast. The fluorescent lamp circuit may also include a pre-existing inductive choke ballast 28, primary inductor 18 being placed in series with inductive choke ballast 28. There are typically spaces available in fluorescent lamp fixtures into which transformer structure 16 may be inserted. When primary inductor 18 is placed in series with inductive choke ballast 28 and the current passing through secondary inductor 20 is sufficient to saturate completely the magnetic core, the effect is almost the same as removing the core of magnetic material entirely; i.e., the inductance of primary inductor 18 is negligible as compared with pre-existing inductive choke ballast 28 and lamp 12 is consequently at full intensity. As the current passing through secondary inductor 20 is reduced, however, the inductance of primary inductor 18 increases, thereby reducing the intensity of light emitted by lamp 12.

Figure 2:
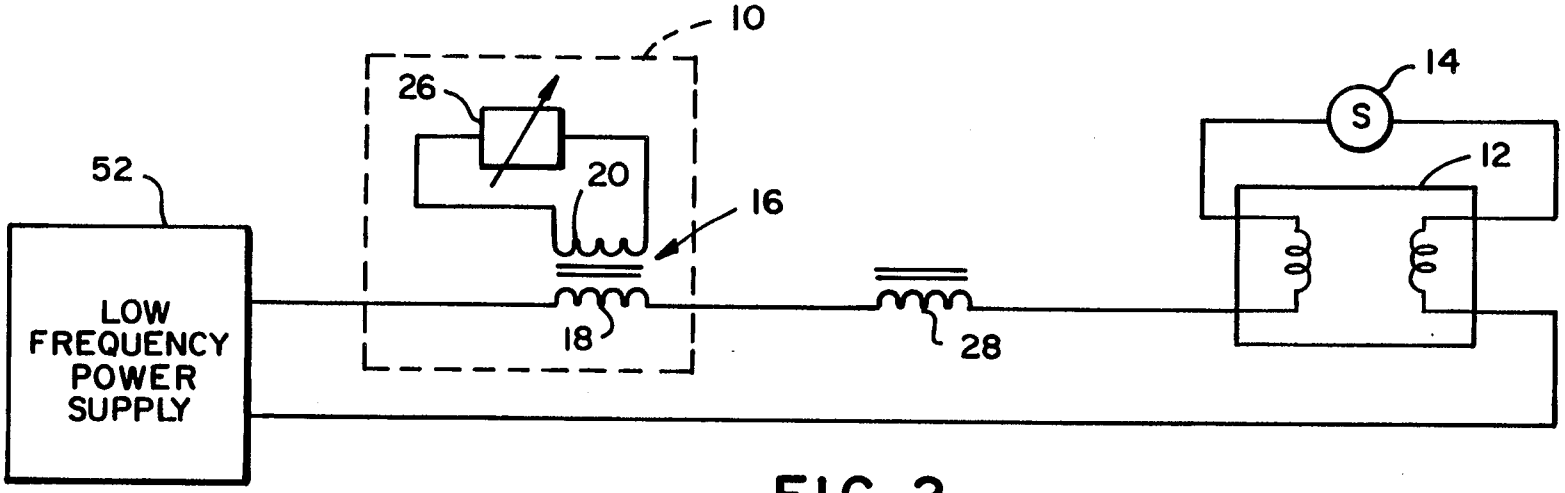
FIG. 2 shows a similar circuit in which the current passing through the secondary inductor is induced in the secondary inductor by current passing through the primary inductor.

With reference now to FIG. 2, there is shown a circuit similar to the one shown in FIG. 1 except that, instead of using diodes in one of the input A.C. power lines to derive a small D.C. voltage for use in the circuit that includes secondary inductor 20, the circuit of FIG. 2 simply utilizes the current induced in secondary inductor 20 by the current passing through primary inductor 18.

Figure 2A:
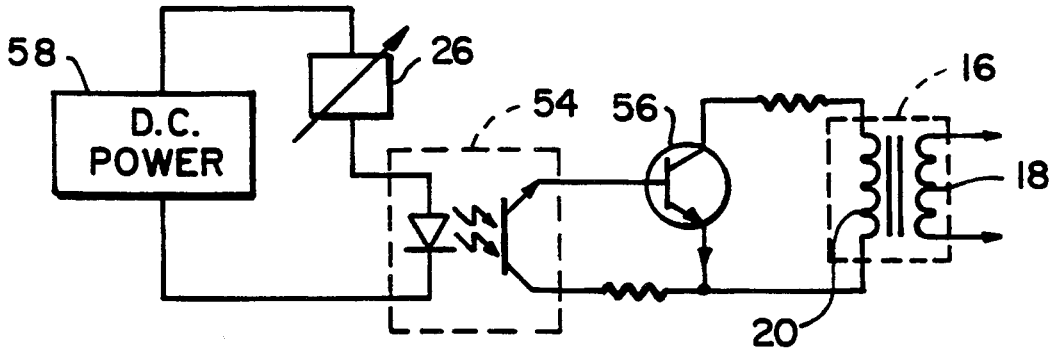
FIG. 2A shows an alternate circuit design for the light regulation device forming part of the circuit of FIG. 2.

Referring to FIG. 2A, there is shown an alternate circuit design for the light regulation device 10 shown in FIG. 2, which permits a very low D.C. current to be used to control the higher induced A.C. current passing through the secondary inductor. A low D.C. voltage of 1.5 to 10 volts, from D.C. power source 58, is applied across control device 26 and the light emitting diode portion of opto-isolator 54, and control device 26 controls the amount of current passing through the light emitting diode portion of opto-isolator 54 (the current being less than about 50 milliamps). The light emitted by the diode has an intensity that varies with the amount of current passing through the diode. This light proportionally controls the amount of current that flows through the transistor portion of opto-isolator 54, and this relatively low current controls power transistor 56, thereby varying the amount of A.C. current passing through secondary inductor 20. The power transistor is used between opto-isolator 54 and secondary inductor 20 because the opto-isolator alone would not be able to handle the amount of A.C. current passing through secondary inductor 20. The isolation between the low D.C. current and the higher A.C. current through secondary inductor 20 provided by opto-isolator 54 and power transistor 56 ensures the safety of control device 26 as it is manipulated by a user and permits control device 26 to be easily located at a remote location (e.g., wired through a wall without special grounding).

Figure 3:
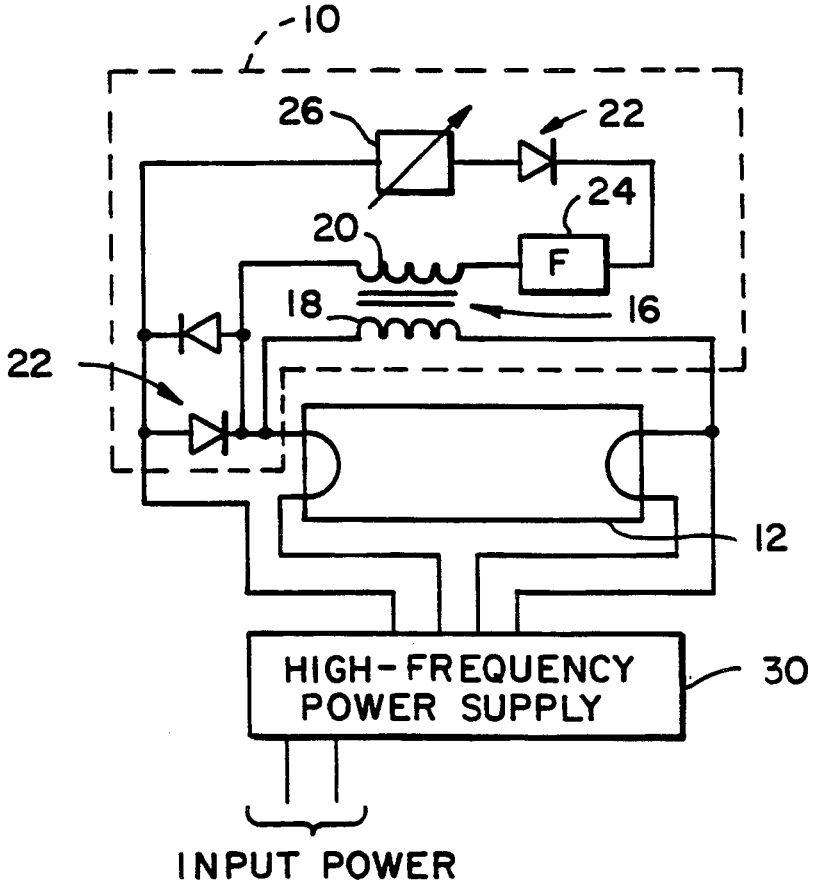
FIG. 3 shows a circuit for regulating light intensity, for use with a fluorescent lamp powered by a high-frequency alternating current.

FIG. 3 shows a circuit, analogous to the one shown in FIG. 1, for regulating the intensity of light emitted by a fluorescent lamp 12 powered by a high-frequency power supply 30 rather than a low-frequency power supply. High-frequency power supply 30, which may include an electronic ballast, operates at a frequency greater than 1 kilohertz. Primary inductor 18 is placed in parallel with fluorescent lamp 12 rather than in series, much the same as the circuit disclosed in the above-mentioned U.S. Pat. No. 5,140,228 filed Feb. 23, 1990, in which a variable inductor is placed in parallel with a fluorescent lamp rather than in series in order to ensure stability of the light output (i.e., in order to prevent the arc inside the lamp from going off when it should be arcing) as the intensity of the light output is varied. When the inductance of primary inductor 18 is increased, the voltage drop across fluorescent lamp 12 correspondingly increases and consequently the intensity of light emitted by fluorescent lamp 12 increases, and vice versa. In this high-frequency configuration power consumption is reduced nearly proportionally to the amount of reduction in light output without any corresponding reduction in lamp life. No starter is needed at high frequency because it is much easier to ionize at these frequencies.

Figure 4:
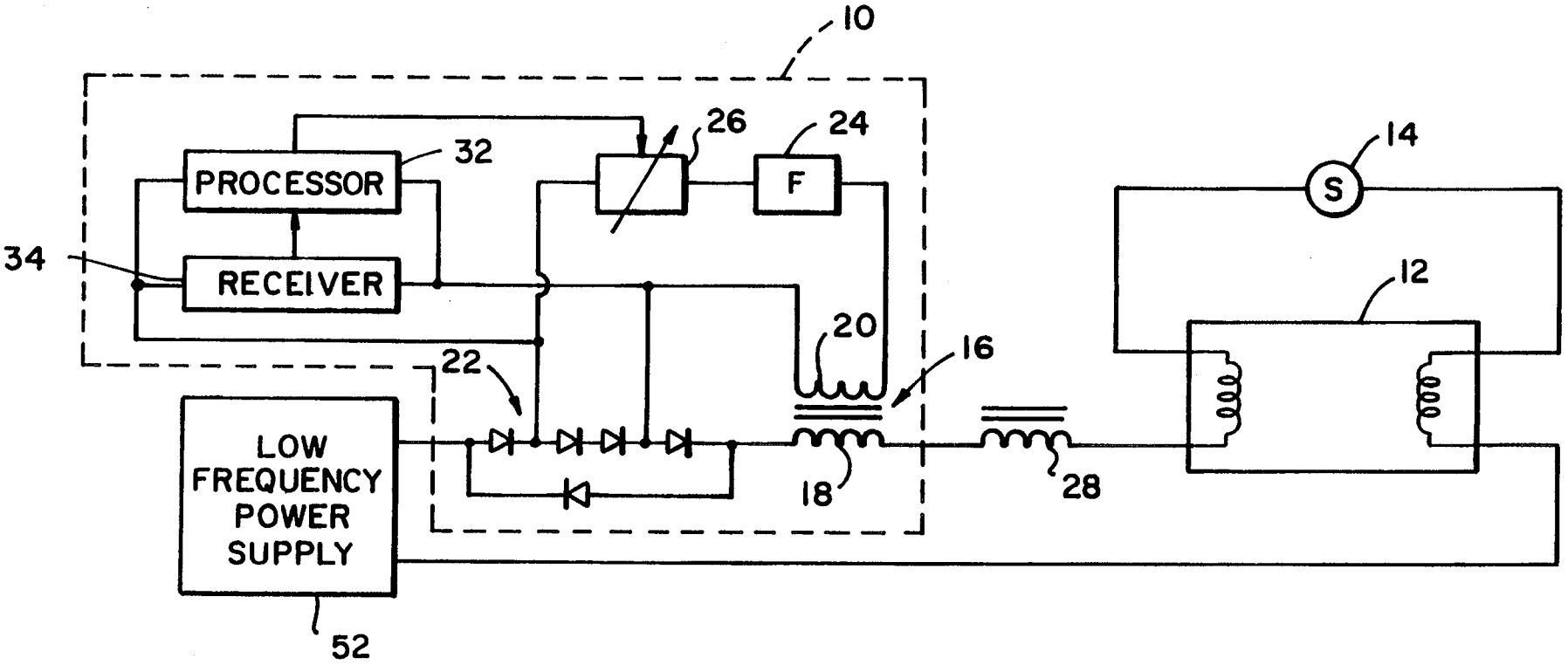
FIG. 4 shows a circuit for regulating light intensity that includes a receiver arranged to detect control signals transmitted from a remote location.

With reference now to FIG. 4, there is shown a circuit for regulating the intensity of light emitted by a lamp 12 powered by a low-frequency power supply 52 (less than 1 kilohertz), in which control device 26 is responsive to input from a processor 32 which in turn receives an input from a receiver 34 arranged to detect control signals transmitted from a remote location. The control signals may be electromagnetic signals (e.g., ultraviolet, infrared, visible light), sonic signals, or even electrical signals transmitted on an electric power line. Thus, for example, an auxiliary channel on a television or VCR remote controller can be dedicated to control of light intensity, so that the VCR remote controller is used in conjunction with both receiver 34 and the receiver present in the television or VCR system, both receivers including opto-couplers that are responsive to electromagnetic signals and operate in a manner similar to transistors. Similarly, receiver 34 may be responsive to a radio transmitter for a garage door in order to vary light intensity when commands for opening or closing the door are given. Likewise, receiver 34 may be responsive to the amount of ambient light in an outdoor location, for the purpose of night turn-on of flood lights, or may operate as a motion detector to determine whether a room is occupied. Receiver 34 could also be responsive to activation transmitters associated with such items as cordless phones, incandescent dimmers, burglar alarms, emergency exit lights, etc. Power for processor 32 and receiver 34 may be provided by the D.C. voltage derived from one of the input A.C. lines by diodes 22. Processor 32 may be in certain embodiments a personal computer. It is relatively easy to use a computer to control the current passing through secondary inductor 20 because of the low voltage in the circuit in which secondary inductor 20 is located.

Figure 5:
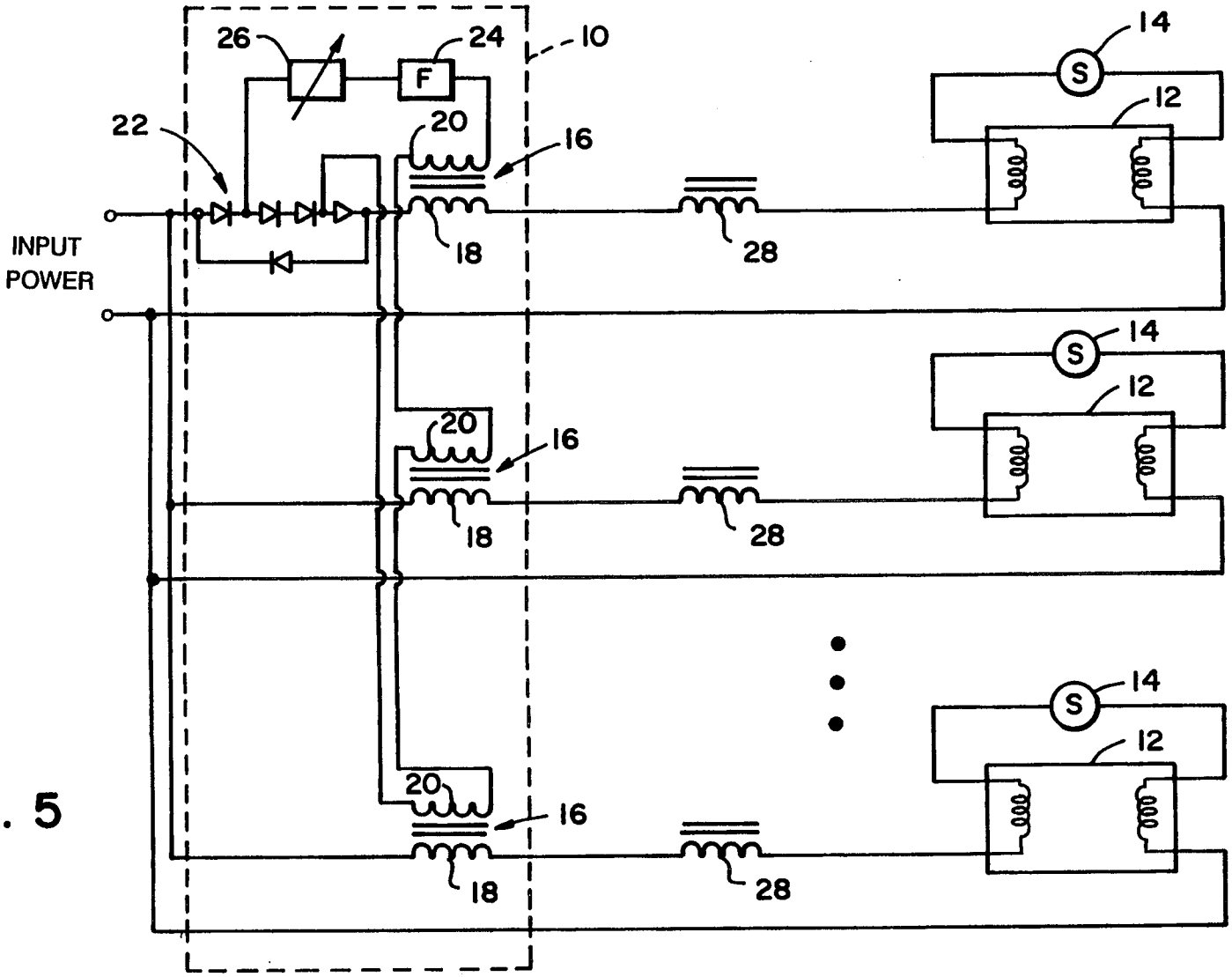
FIG. 5 shows a circuit for regulating the light intensity of a plurality of lamps.

FIG. 5 shows how the invention can be used to regulate simultaneously the light intensity of a plurality of fluorescent lamps 12. A single control device 26 is connected to a plurality of secondary inductors 20 to vary simultaneously the electrical current passing through each of the secondary inductors. Secondary inductors 20 are preferably connected in series as shown in FIG. 5, but may also be connected in parallel. Each secondary inductor 20 is associated with a corresponding primary inductor 18, which is in turn associated with a corresponding fluorescent lamp 12. All of the circuit elements are the same as the those that would be used with a single lamp. Thus, this configuration permits a plurality of lamps to be dimmed simultaneously, without connecting all of the lamps to a single variable inductor specially selected to have a range of inductance appropriate to the number of lamps to which it is connected. In addition, each of transformer structures 16 may be retro-fitted to existing fluorescent lamp circuits connected to a pre-existing power supply and possibly including pre-existing inductive choke ballasts 28.

Figure 6:
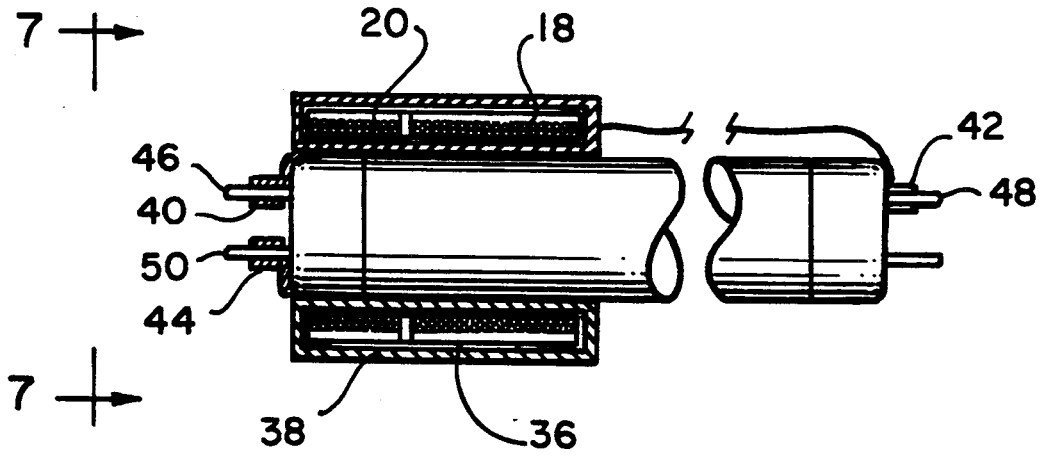
FIG. 6 shows an assembly, including primary and secondary windings and magnetic core pieces, that is slidably attached to the end of a fluorescent lamp.
Figure 7:
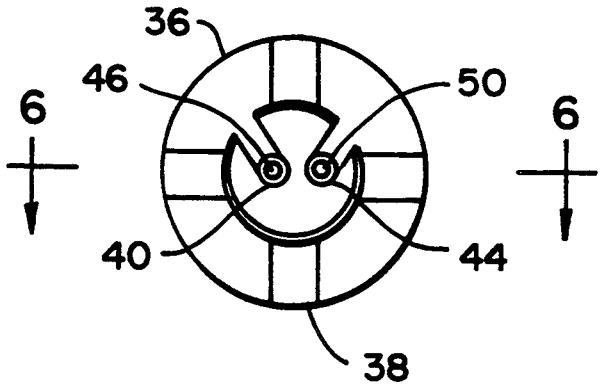
FIG. 7 is an end view of the assembly shown in FIG. 6, taken along line 7—7.

With reference now to FIGS. 6 and 7, in one embodiment of the invention, which utilizes the circuit design shown in FIG. 3, primary inductor 18 and secondary inductor 20 are wound around a cylindrical bobbin 36 constructed to fit over the end of fluorescent lamp 12 as a slide-on socket. There are four cores 38 of magnetic material (although more or fewer cores may be used, depending on the construction and composition of the cores), which are rectangular in shape and enclose a region through which the primary and secondary inductors pass and fit within indentations in bobbin 36. Bobbin 36 entirely covers and insulates primary inductor 18 and secondary inductor 20.

Slip-on terminals 40, 42, and 44 are configured to slip over pins 46, 48, and 50 of the lamp respectively, with slip-on terminals 40 and 42 providing a pair of electrical connections between primary inductor 18 and pins 46 and 48, and slip-on terminal 40 additionally providing an electrical connection between secondary inductor 20 and pin 46. The actual electrical connections are not shown in FIG. 6, but can be understood from the circuit diagram shown in FIG. 3. Slip-on terminal 44 is present for structural symmetry but provides no electrical connection.

A package consisting of diodes 22, control device 26, and filter 24 (all shown in FIG. 3) is located in a remote location and is electrically connected somewhere between high-frequency power supply 30 and lamp pin 46. An electrical connection is provided between this package and secondary inductor 20. This electrical connection is not shown in FIG. 6, but appears as the electrical connection between filter 24 and secondary inductor 20 in FIG. 3.

It can be seen that the entire assembly shown in FIGS. 6 and 7 is easily attachable to fluorescent lamp 12 by sliding the assembly over one of the ends of lamp 12 and attaching the slip-on terminals to the lamp pins.

There has been described novel and improved apparatus and techniques for regulating the intensity of light emitted by a lamp. It is evident that those skilled in the art may now make numerous uses and modifications of and departures from the specific embodiment described herein without departing from the inventive concept. Consequently, the invention is to be construed as embracing each and every novel feature and novel combination of features present in or possessed by the apparatus and technique herein disclosed and limited solely by the spirit and scope of the appended claims.

What is claimed is:

1. A method of retro-fitting a light intensity regulation device to an assembly comprising a lamp and a power supply, comprising steps for:

providing a light intensity regulation device, comprising:

a core of magnetic material, a first electrical circuit means comprising a primary inductor wrapped around at least a first portion of said core of magnetic material, and a second electrical circuit means comprising a secondary inductor wrapped around at least a second portion of said core of magnetic material, said first electrical circuit means being designed for electrical connection to a lamp, said primary inductor being arranged in said first electrical circuit means in a manner such that a variation in the inductance of said primary inductor will cause a corresponding variation in the intensity of light emitted by said lamp while said lamp is connected to said first electrical circuit means, said second electrical circuit means comprising a control device means for varying, at will, electrical current passing through said secondary inductor to cause a variation in the inductance of said primary inductor, thereby causing a change in the intensity of light emitted by said lamp, and retro-fitting said light intensity regulation device to an assembly comprising said lamp and a power supply that produces electrical current of a frequency suitable for said lamp, in a manner such that said first electrical circuit means comprising said primary inductor is electrically connected to said lamp and to at least one output terminal of said power supply.

2. A device for regulating the current passing through a plurality of loads, comprising:

a plurality of cores of magnetic material, a plurality of first electrical circuit means each comprising a respective one of a plurality of primary inductors wrapped around at least a first portion of a respective one of said plurality of cores of magnetic material, and a second electrical circuit means comprising a plurality of secondary inductors, each of which is wrapped around at least a second portion of a respective one of said plurality of cores of magnetic material, each of said plurality of first electrical circuit means being designed for independent electrical connection to a respective one of said plurality of loads, and having said respective one of said primary inductors arranged in said first electrical circuit means in a manner such that a variation in the inductance of said primary inductor will cause a corresponding variation in the current passing through said load while said load is connected to said first electrical circuit means, said second electrical circuit means comprising a control device means for simultaneously varying, at will, electrical current passing through each of said plurality of secondary inductors to cause a variation in the inductance of each of said primary inductors, thereby causing a change in the current passing through each of said plurality of loads.

3. A device in accordance with claim 2, wherein each of said loads comprises a lamp.

4. A device in accordance with claim 3, wherein each of said lamps is a discharge lamp.

5. A device in accordance with claim 4, wherein each of said discharge lamps is a fluorescent lamp.

6. A device for regulating the current passing through a load, comprising:

a core of magnetic material, a first electrical circuit means comprising a primary inductor wrapped around at least a first portion of said core of magnetic material, and a second electrical circuit means comprising a secondary inductor wrapped around at least a second portion of said core of magnetic material, said first electrical circuit means being designed for electrical connection to said load, said primary inductor being arranged in said first electrical circuit means in a manner such that a variation in the inductance of said primary inductor will cause a corresponding variation in the current passing through said load while said load is connected to said first electrical circuit means, said second electrical circuit means comprising a control device means for varying, at will, electrical current passing through said secondary inductor to cause a variation in the inductance of said primary inductor, thereby causing a change in the current passing through said load, said first electrical circuit means and said load being designed for use with currents having frequencies above 1 kilohertz.

7. A device in accordance with claim 6, wherein said primary inductor is connected in parallel with said load when said load is connected to said first electrical circuit means.

8. A device in accordance with claim 6, wherein said load comprises a lamp.

9. A device in accordance with claim 8, wherein said lamp is a discharge lamp.

10. A device in accordance with claim 9, wherein said discharge lamp is a fluorescent lamp.

11. A device for regulating the current passing through a load, comprising:

a core of magnetic material, a first electrical circuit means comprising a primary inductor wrapped around at least a first portion of said core of magnetic material, and a second electrical circuit means comprising a secondary inductor wrapped around at least a second portion of said core of magnetic material, said first electrical circuit means being designed for electrical connection to said load, said primary inductor being arranged in said first electrical circuit means in a manner such that a variation in the inductance of said primary inductor will cause a corresponding variation in the current passing through said load while said load is connected to said first electrical circuit means, said second electrical circuit means comprising a control device means for varying, at will, electrical current passing through said secondary inductor to cause a variation in the inductance of said primary inductor, thereby causing a change in the current passing through said load, said current regulation device further comprising an isolation device for isolating one portion of said second electrical circuit means, comprising said secondary inductor, from another portion of said electrical circuit means, comprising said control device means.

12. A device in accordance with claim 11, wherein said isolation device comprises an opto-isolator.

13. A device in accordance with claim 11, wherein said isolation device comprises a transistor.

14. A device in accordance with claim 11, wherein said current passing through said secondary inductor is an alternating current induced in said secondary inductor by current passing through said primary inductor.

15. A device in accordance with claim 11, wherein said load comprises a lamp.

16. A device in accordance with claim 11, wherein said lamp is a discharge lamp.

17. A device in accordance with claim 16, wherein said discharge lamp is a fluorescent lamp.

18. A device for regulating the current passing through a load, comprising:

a core of magnetic material, a first electrical circuit means comprising a primary inductor wrapped around at least a first portion of said core of magnetic material, and a second electrical circuit means comprising a secondary inductor wrapped around at least a second portion of said core of magnetic material, said first electrical circuit means being designed for electrical connection to said load, said primary inductor being arranged in said first electrical circuit means in a manner such that a variation in the inductance of said primary inductor will cause a corresponding variation in the current passing through said load while said load is connected to said first electrical circuit means, said second electrical circuit means comprising a control device means for varying, at will, electrical current passing through said secondary inductor to cause a variation in the inductance of said primary inductor, thereby causing a change in the current passing through said load, the variation of said electrical current passing through said secondary inductor causing a variation in a magnetic flux that follows a path passing through said first and second portions of said core of magnetic material, said variation in the inductance of said primary inductor being directly caused by said variation in said magnetic fluid as said magnetic flux passes through said first portion of said core of magnetic material.

wherein said current passing through said secondary inductor is a non-rectified alternating current.

19. A device in accordance with claim 18 wherein said alternating current is induced in said secondary inductor by current passing through said primary inductor.

20. A device in accordance with claim 18, wherein said second electrical circuit means is powered by a voltage sufficiently low to be safe in the event of human contact with said voltage.

21. A device in accordance with claim 18, wherein said control device means is constructed to be manually adjusted to vary said electrical current passing through said secondary inductor.

22. A device in accordance with claim 18, wherein said first electrical circuit means further comprises a power supply that produces electrical current of a frequency suitable for said lamp, and said primary inductor is electrically connected to at least one output terminal of said power supply.

23. A device in accordance with claim 22, wherein said primary inductor is connected between said output terminal of said power supply and said lamp.

24. A device in accordance with claim 22, wherein said primary inductor is connected in parallel with said lamp.

25. A device in accordance with claim 22, wherein said first electrical circuit means further comprises an inductive ballast in addition to said primary inductor.

26. A device in accordance with claim 25, wherein said inductive ballast comprises an electronic ballast incorporated into said power supply.

27. A device in accordance with claim 25, wherein said inductive ballast comprises a choke ballast connected in series with said primary inductor.

28. A device in accordance with claim 18, wherein said load comprises a lamp.

29. A device in accordance with claim 28, wherein said lamp is a discharge lamp.

30. A device in accordance with claim 29, wherein said discharge lamp is a fluorescent lamp.

* * * * *